United States Patent [19]

Cavazza

[11] Patent Number: 4,519,111

[45] Date of Patent: May 28, 1985

[54] TOOTHBRUSH HAVING SERIES OF BRISTLES OF DIFFERENT HEIGHT

[76] Inventor: Paolo Cavazza, Viale dell'Umanesimo 178, Rome, Italy

[21] Appl. No.: 436,706

[22] Filed: Oct. 26, 1982

[30] Foreign Application Priority Data

Nov. 6, 1981 [IT] Italy ..... 36121/81[U]

[51] Int. Cl.[3] ..... A46B 9/04

[52] U.S. Cl. ..... 15/167 R; 15/DIG. 5

[58] Field of Search ..... 15/167 R, 167 A, 110, 15/106, 159 R, DIG. 5

[56] References Cited

U.S. PATENT DOCUMENTS 860,840 7/1907 Strassburger ..... 15/167 R 1,943,225 1/1934 McIntyre ..... 15/167 R 3,742,549 7/1973 Scopp et al. ..... 15/167 R

FOREIGN PATENT DOCUMENTS 683311 2/1930 France ..... 15/167 R

*Primary Examiner*—Peter Feldman

[57] ABSTRACT

The object of the present invention is a toothbrush having the bristles grouped into tufts arranged in parallel rows, said bristles consisting of a first series of tufts whose height becomes greater the more distant they are from the end of the toothbrush opposite to the handle thereof, and of a second series of tufts of constant height, which alternate regularly with the tufts of bristles of the first series.

2 Claims, 3 Drawing Figures

Figures 1, 2, 3:
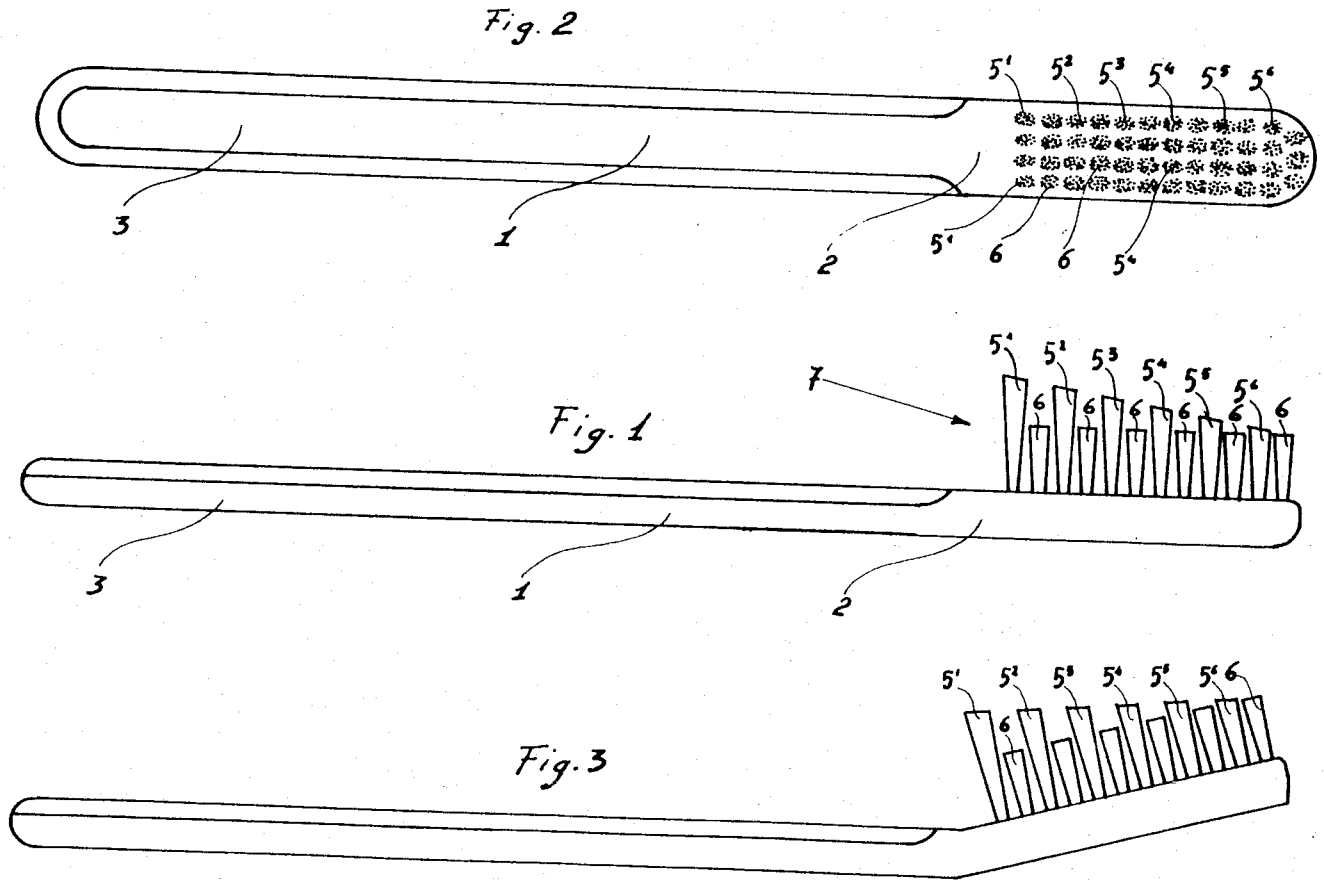

1
2
3
4
5
6

TOOTHBRUSH HAVING SERIES OF BRISTLES OF DIFFERENT HEIGHT

The present invention relates to a toothbrush provided with tufts of bristles having different height.

There have been known since long toothbrushes having bristles whose height is not constant but varies, so that the cleansing surface formed by the top of the bristles anatomically fits the average curvature of the users' dental arch. In particular, there is known a toothbrush whose bristles are all arranged according to a "scalar" dispostion, that is to say they get higher, in linear progression, as the distance between them and the toothbrush end opposite to the handle increases.

This kind of scalar toothbrush offers several advantages if compared to the conventional toothbrushes; for instance, it allows to reach easily the farthest back molars, even in subjects having a narrow oral rima or vestibule; to satisfactorily remove food deposits from the gingival crevices, and to remove as well the bacterial plaque, effecting at the same time a stimulating massage on gums.

It has now been found that all the advantageous results obtained by employing the scalar toothbrush can be further improved by means of a toothbrush having bristles arranged in tufts set in parallel rows, characterized in that the bristles are grouped into a first series of tufts which become higher the more distant they are from the end of the toothbrush opposite to the handle thereof, and into a second series of tufts of constant height, each tuft of the first series alternating with another of the second series. According to a preferred embodiment of the toothbrush which is the subject of the present invention, the height of the bristles belonging to the first series increases in a linear progression the more far away said bristles are from the end of the toothbrush opposite to the handle thereof. In fact, if the toothbrush is used in accordance with the mode of operation provided by the present invention, it results that the bristles of constant height, as they gently massage the gums, work together with the bristles of different height in reaching the most inaccessible spaces between the teeth.

The present invention can be better understood by the following detailed description, made by mere way of example, with specific reference to the accompanying drawings, wherein in FIGS. 2, 1 and 3 there are shown a plan view and two side views respectively of a toothbrush according to the present invention.

It should be noted that, although the attached drawing shows a toothbrush having a straight handle, the particular bristle unit which is the distinctive character of the present invention can well be equally applied to an "angular" toothbrush, by which term there is meant a toothbrush having both the same inclination as a dental mirror and the opposite inclination (in the first case the angulation is inferior to 180°, in the second case it is superior to 180°).

A toothbrush according to the present invention comprises substantially a handle 1, straight and stiff, which, at the end 2 (opposite to handle 3) is provided with a series of holes arranged in parallel rows, wherein the tufts of bristles are inserted.

With special reference to FIG. 1, the bristle units consists of a first series of bristles ($5^1$, $5^2$, $5^3$, $5^4$, $5^5$, $5^6$) whose height increases in linear progression the more distant the bristles themselves are from the extremity 2 of the toothbrush, opposite to handle 3, and of a second series of bristles (6) which regularly alternate with the tufts of the first series, the height of the tufts of the latter series being constant.

Although in the practical embodiment of a toothbrush according to the invention as shown in FIGS. 1, 2 and 3 the height of the tufts of the 6 series is slightly lower than the height of the first tuft $5^1$ of the $5^1$, $5^2$, $5^3$ . . . series of increasing height, it is understood that there are regarded as falling within the ambit of the present invention even those toothbrushes wherein the height of the first tuft (6) of the constant-height series is the same or slightly greater than that of the first tuft ($5^1$) of the variable-height series.

Obviously, both the sizes and the materials used in the making of the handle and bristles may broadly vary, as is evident to any person skilled in the toothbrushes manufacture.

For instance, the material chosen for bristles will be different depending on whether a toothbrush with medium-hard, medium-soft or soft bristles is desired.

I claim:

1. A toothbrush having the bristles grouped into tufts arranged in parallel rows, characterized in that the bristles as a whole (7) consist of a first series of tufts ($5^1$, $5^2$, $5^3$ . . . ) whose height becomes greater the more distant they are from the end of the toothbrush opposite to the handle, and of a second series of tufts (6) of constant height, which alternate regularly with the tufts of bristles of the first series.

2. A toothbrush according to claim 1, characterized in that the height of the bristles ($5^1$, $5^2$, $5^3$ . . . ) of said first series becomes greater, in a linear manner, as the distance between said bristles and the end of the toothbrush opposite to the handle increases.

* * * * *